US007067986B2

(12) United States Patent
Wong et al.

(10) Patent No.: US 7,067,986 B2
(45) Date of Patent: Jun. 27, 2006

(54) FREQUENCY CONTROLLED LIGHTING SYSTEM

(75) Inventors: Wai Kai Wong, Kowloon (HK); Lai Cheong Mak, Kowloon (HK)

(73) Assignee: Cheerine Development (Hong Kong) Limited, Kowloon (CN)

( * ) Notice: Subject to any disclaimer, the term of this patent is extended or adjusted under 35 U.S.C. 154(b) by 293 days.

(21) Appl. No.: 10/662,796

(22) Filed: Sep. 15, 2003

(65) Prior Publication Data

US 2005/0057919 A1 Mar. 17, 2005

(51) Int. Cl.
*H05B 37/00* (2006.01)

(52) U.S. Cl. ..... 315/200 A; 315/360; 315/323; 315/291; 315/225; 315/312

(58) Field of Classification Search ..... 315/291, 315/200 A, 225, 76, 224, 312, 323, 360, 315/241 R, 307; 362/103, 227, 231, 251, 362/265, 800, 802
See application file for complete search history.

(56) References Cited

U.S. PATENT DOCUMENTS

| | | | |
|---|---|---|---|
| 1,597,823 | A | 8/1926 | Randolph |
| 1,933,243 | A | 10/1933 | De Merolis et al. |
| 2,572,760 | A | 10/1951 | Rikelman |
| 2,634,407 | A | 4/1953 | Johnson |
| 2,671,209 | A | 3/1954 | Habib |
| 2,671,847 | A | 3/1954 | Lerch |
| 2,816,284 | A | 12/1957 | Campanell |
| 2,849,819 | A | 9/1958 | Murphy et al. |
| 2,931,893 | A | 4/1960 | Gonzalez et al. |
| 2,959,892 | A | 11/1960 | Johnson |
| 2,976,622 | A | 3/1961 | Shearouse |
| 3,008,038 | A | 11/1961 | Dickens et al. |
| 3,053,949 | A | 9/1962 | Johnson |

(Continued)

FOREIGN PATENT DOCUMENTS

CN 2063363 U 10/1990

(Continued)

OTHER PUBLICATIONS

Combined Search and Examination Report dated Jul. 15, 2003, for corresponding United Kingdom application GB 0306157.9.

*Primary Examiner*—Haissa Philogene
(74) *Attorney, Agent, or Firm*—Brinks Hofer Gilson & Lione

(57) ABSTRACT

A method and apparatus for illuminating lighting elements in one or more predetermined patterns. A preferred frequency controlled lighting system implementing this method includes a motion switch, a controller, and lighting elements. The motion switch creates an activation signal in response to movement of the motions switch, the activation signal indicating at least one of duration of electrical engagement or frequency of electrical engagement within the motion switch. The controller detects the activation signal generation and uses a signal analysis system to analyze the activation signal. Preferably, a short signal circuit within the signal analysis system detects when the duration of electrical engagement is less than or equal to a predetermined duration level, a long duration circuit within the signal analysis system detects when the duration of electrical engagement is greater than the predetermined duration level, and a fast frequency circuit detects when the frequency of electrical engagement is greater than a predetermined frequency threshold. In response to properties of the activation signal, the signal analysis system commands a pattern generator to illuminate the lighting elements in one or more predetermined patterns.

63 Claims, 10 Drawing Sheets

U.S. PATENT DOCUMENTS

| | | | | |
|---|---|---|---|---|
| 3,070,907 | A | | 1/1963 | Rocco |
| 3,502,831 | A | | 3/1970 | McRoskey |
| 3,564,232 | A | | 2/1971 | Ellerbe |
| 3,731,022 | A | | 5/1973 | Loftus |
| 3,800,133 | A | | 3/1974 | Duval |
| 3,893,247 | A | | 7/1975 | Dana, III |
| 3,946,505 | A | | 3/1976 | Dana, III |
| 3,968,641 | A | | 7/1976 | Moyer |
| 4,009,387 | A | | 2/1977 | Nuver |
| 4,014,115 | A | | 3/1977 | Reichert |
| 4,020,572 | A | | 5/1977 | Chiaramonte, Jr. |
| 4,128,861 | A | | 12/1978 | Pelengaris |
| 4,130,951 | A | | 12/1978 | Powell |
| 4,158,922 | A | | 6/1979 | Dana, III |
| 4,231,079 | A | | 10/1980 | Heminover |
| 4,253,253 | A | | 3/1981 | McCormick |
| 4,298,917 | A | | 11/1981 | Ware |
| 4,308,572 | A | | 12/1981 | Davidson et al. |
| 4,350,853 | A | | 9/1982 | Ganyard |
| 4,363,502 | A | | 12/1982 | Bakerman |
| 4,367,515 | A | | 1/1983 | Beard |
| 4,412,205 | A | | 10/1983 | Von Kemenczky |
| 4,422,719 | A | | 12/1983 | Orcutt |
| 4,459,645 | A | | 7/1984 | Glatter |
| 4,463,412 | A | | 7/1984 | Broach |
| 4,489,957 | A | | 12/1984 | Holmgren |
| 4,518,274 | A | | 5/1985 | Hanggi |
| 4,588,387 | A | | 5/1986 | Swenson |
| 4,701,146 | A | | 10/1987 | Swenson |
| 4,765,701 | A | | 8/1988 | Cheslak |
| 4,800,469 | A | | 1/1989 | Leon |
| 4,848,009 | A | | 7/1989 | Rodgers |
| 4,870,325 | A | | 9/1989 | Kazar |
| 4,897,947 | A | | 2/1990 | Kass-Pious |
| 4,995,294 | A | | 2/1991 | Kashio et al. |
| 5,016,144 | A | | 5/1991 | DiMaggio |
| 5,027,035 | A | | 6/1991 | McGrail et al. |
| 5,033,212 | A | | 7/1991 | Evanyk |
| 5,052,131 | A | | 10/1991 | Rondini |
| 5,070,431 | A | | 12/1991 | Kitazawa et al. |
| 5,099,192 | A | | 3/1992 | Thayer et al. |
| 5,113,325 | A | | 5/1992 | Eisenbraun |
| 5,128,842 | A | | 7/1992 | Kenmochi |
| 5,188,447 | A | | 2/1993 | Chiang et al. |
| 5,235,761 | A | | 8/1993 | Chang |
| 5,237,760 | A | | 8/1993 | Altman et al. |
| 5,245,517 | A | * | 9/1993 | Fenton ..... 362/156 |
| 5,285,586 | A | | 2/1994 | Goldston et al. |
| 5,303,131 | A | | 4/1994 | Wu |
| 5,303,485 | A | | 4/1994 | Goldston et al. |
| 5,313,187 | A | | 5/1994 | Choi et al. |
| 5,327,329 | A | | 7/1994 | Stiles |
| 5,343,190 | A | | 8/1994 | Rodgers |
| 5,353,441 | A | | 10/1994 | Lazorchak |
| 5,357,697 | A | | 10/1994 | Lin |
| 5,371,662 | A | | 12/1994 | Shen-Ko |
| 5,381,615 | A | | 1/1995 | MacMillan |
| 5,388,038 | A | | 2/1995 | Yang |
| 5,396,720 | A | | 3/1995 | Hwang et al. |
| 5,400,232 | A | | 3/1995 | Wong |
| 5,406,724 | A | | 4/1995 | Lin |
| 5,408,764 | A | | 4/1995 | Wut |
| 5,419,061 | A | | 5/1995 | Barrocas |
| 5,422,628 | A | | 6/1995 | Rodgers |
| 5,438,488 | A | | 8/1995 | Dion |
| 5,438,493 | A | | 8/1995 | Tseng |
| 5,455,749 | A | | 10/1995 | Ferber |
| 5,456,032 | A | | 10/1995 | Matsumoto et al. |
| 5,457,900 | A | | 10/1995 | Roy |
| 5,461,188 | A | | 10/1995 | Drago et al. |
| 5,463,537 | A | | 10/1995 | Trattner et al. |
| 5,465,197 | A | | 11/1995 | Chien |
| 5,475,572 | A | | 12/1995 | Tseng |
| 5,477,435 | A | | 12/1995 | Rapisarda et al. |
| 5,477,437 | A | | 12/1995 | Lach |
| 5,483,759 | A | | 1/1996 | Silverman |
| 5,485,358 | A | | 1/1996 | Chien |
| 5,490,338 | A | | 2/1996 | Hwang et al. |
| 5,495,136 | A | | 2/1996 | Chiang et al. |
| 5,495,682 | A | | 3/1996 | Chen |
| 5,500,635 | A | | 3/1996 | Mott |
| 5,508,899 | A | | 4/1996 | McCormick |
| 5,516,149 | A | | 5/1996 | Moore |
| 5,523,928 | A | | 6/1996 | Kim |
| 5,544,967 | A | | 8/1996 | Yao |
| 5,546,681 | A | | 8/1996 | Goldston et al. |
| 5,550,721 | A | | 8/1996 | Rapisarda |
| 5,552,971 | A | | 9/1996 | Madden |
| 5,566,479 | A | | 10/1996 | Gray et al. |
| 5,575,554 | A | | 11/1996 | Guritz |
| 5,577,828 | A | | 11/1996 | Nadel et al. |
| 5,588,734 | A | | 12/1996 | Talamo et al. |
| 5,590,945 | A | | 1/1997 | Simms |
| 5,599,088 | A | | 2/1997 | Chien |
| 5,604,999 | A | | 2/1997 | Barker |
| 5,617,304 | A | | 4/1997 | Huang |
| 5,644,858 | A | | 7/1997 | Bemis |
| 5,649,755 | A | | 7/1997 | Rapisarda |
| 5,653,523 | A | | 8/1997 | Roberts |
| 5,656,805 | A | | 8/1997 | Plesko |
| 5,663,614 | A | | 9/1997 | Weng et al. |
| 5,664,862 | A | | 9/1997 | Redmond et al. |
| 5,673,996 | A | | 10/1997 | Ducker |
| 5,683,164 | A | | 11/1997 | Chien |
| 5,709,464 | A | | 1/1998 | Tseng |
| 5,716,119 | A | | 2/1998 | Patel |
| 5,722,757 | A | | 3/1998 | Chien |
| 5,730,520 | A | | 3/1998 | Hsu et al. |
| 5,730,539 | A | | 3/1998 | Chabria |
| 5,732,486 | A | | 3/1998 | Rapisarda |
| 5,735,592 | A | | 4/1998 | Shu |
| 5,746,499 | A | | 5/1998 | Ratcliffe et al. |
| 5,746,500 | A | | 5/1998 | Chien |
| 5,754,064 | A | | 5/1998 | Chien |
| 5,758,946 | A | | 6/1998 | Chen |
| 5,779,344 | A | | 7/1998 | Tseng |
| 5,789,716 | A | | 8/1998 | Wang |
| 5,812,063 | A | | 9/1998 | Weng et al. |
| 5,813,148 | A | | 9/1998 | Guerra |
| 5,821,858 | A | | 10/1998 | Stone |
| 5,839,814 | A | | 11/1998 | Roberts |
| 5,844,377 | A | | 12/1998 | Anderson et al. |
| 5,855,382 | A | | 1/1999 | Reilly et al. |
| 5,866,987 | A | | 2/1999 | Wut |
| 5,894,201 | A | | 4/1999 | Wong |
| 5,903,103 | A | | 5/1999 | Garner |
| 5,909,088 | A | | 6/1999 | Wut |
| 5,921,653 | A | | 7/1999 | Chien |
| 5,932,975 | A | | 8/1999 | Wut |
| 5,934,784 | A | | 8/1999 | Dion |
| 5,945,911 | A | | 8/1999 | Healy et al. |
| 5,955,712 | A | | 9/1999 | Zakutin |
| 5,957,541 | A | | 9/1999 | Seigler |
| 5,969,311 | A | | 10/1999 | Mader |
| 5,969,479 | A | | 10/1999 | Wong |
| 6,012,822 | A | | 1/2000 | Robinson |
| 6,060,673 | A | | 5/2000 | Jackman |
| 6,065,851 | A | | 5/2000 | So |
| 6,094,141 | A | | 7/2000 | Tsai |
| 6,099,185 | A | | 8/2000 | Huang et al. |
| 6,104,140 | A | | 8/2000 | Wut et al. |
| 6,106,132 | A | | 8/2000 | Chen |
| 6,112,437 | A | | 9/2000 | Lovitt |
| 6,129,473 | A | | 10/2000 | Shu |

| | | | | |
|---|---|---|---|---|
| 6,145,999 | A | 11/2000 | Van Derlande | |
| 6,158,871 | A | 12/2000 | Geddes et al. | |
| 6,164,794 | A | 12/2000 | Rodgers | |
| 6,170,968 | B1 | 1/2001 | Caswell | |
| RE37,220 | E | 6/2001 | Rapisarda et al. | |
| 6,241,371 | B1 | 6/2001 | Dai | |
| 6,246,186 | B1 | 6/2001 | Nieberger | |
| 6,261,018 | B1 | 7/2001 | Chen | |
| 6,280,045 | B1 | 8/2001 | Anteby et al. | |
| 6,332,692 | B1 | 12/2001 | McCurdy | |
| 6,348,766 | B1 | 2/2002 | Ohishi et al. | |
| 6,354,712 | B1 | 3/2002 | Anteby | |
| 6,360,615 | B1 | 3/2002 | Smela | |
| 6,398,395 | B1 | 6/2002 | Hyun | |
| 6,408,545 | B1 | 6/2002 | Song | |
| 6,416,327 | B1 | 7/2002 | Wittenbecher | |
| 6,525,487 | B1 | 2/2003 | Wei | |
| 6,619,812 | B1 | 9/2003 | Rapisarda | |
| 6,682,202 | B1 * | 1/2004 | Wong | 362/118 |
| 6,776,498 | B1 * | 8/2004 | Yeung | 362/103 |
| 6,843,578 | B1 * | 1/2005 | Cheung | 362/103 |
| 2002/0186151 | A1 * | 12/2002 | Greenberg | 340/999 |
| 2003/0137852 | A1 | 7/2003 | Rapisarda | |
| 2003/0185019 | A1 | 10/2003 | Rogers et al. | |
| 2004/0251837 | A1 | 12/2004 | Leung et al. | |
| 2005/0057188 | A1 * | 3/2005 | Wong et al. | 315/291 |

FOREIGN PATENT DOCUMENTS

| | | | |
|---|---|---|---|
| CN | 2084731 | U | 9/1991 |
| CN | 2096471 | U | 2/1992 |
| CN | 2096910 | U | 2/1992 |
| CN | 2131725 | Y | 5/1993 |
| CN | 2167582 | Y | 6/1994 |
| CN | 2198731 | Y | 5/1995 |
| CN | 2448567 | Y | 9/2001 |
| EP | 0 121 026 | A1 | 6/1993 |
| EP | 0 335 467 | B1 | 6/1993 |
| EP | 0 427 920 | B1 | 6/1994 |
| EP | 0 773 529 | B1 | 5/1997 |
| EP | 0 888 034 | A | 12/1998 |
| GB | 2 361 624 | A | 10/2001 |
| JP | 354-133766 | A | 10/1979 |
| JP | 355-080376 | A | 6/1980 |
| JP | 54-133766 | A | 10/1989 |
| JP | 405-021188 | A | 1/1993 |
| JP | 7-112596 | | 5/1995 |
| JP | 10-232635 | | 9/1998 |
| JP | 10-309889 | | 11/1998 |
| JP | 11-7802 | | 1/1999 |
| JP | 2000-37989 | A | 2/2000 |
| WO | WO 93/11681 | | 1/1993 |

* cited by examiner

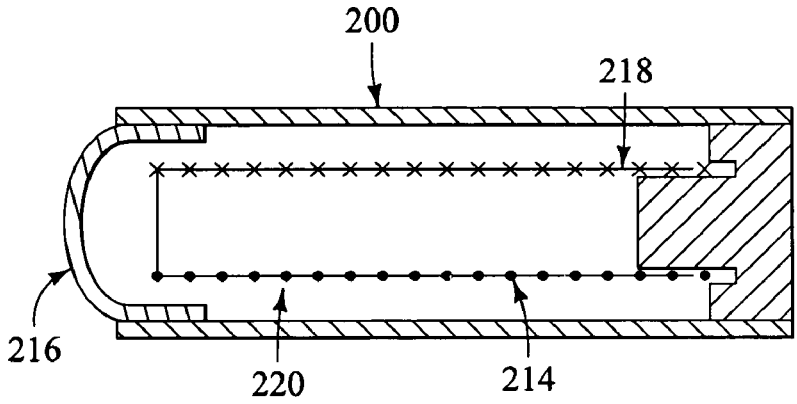
FIG. 2A
FIG. 2B
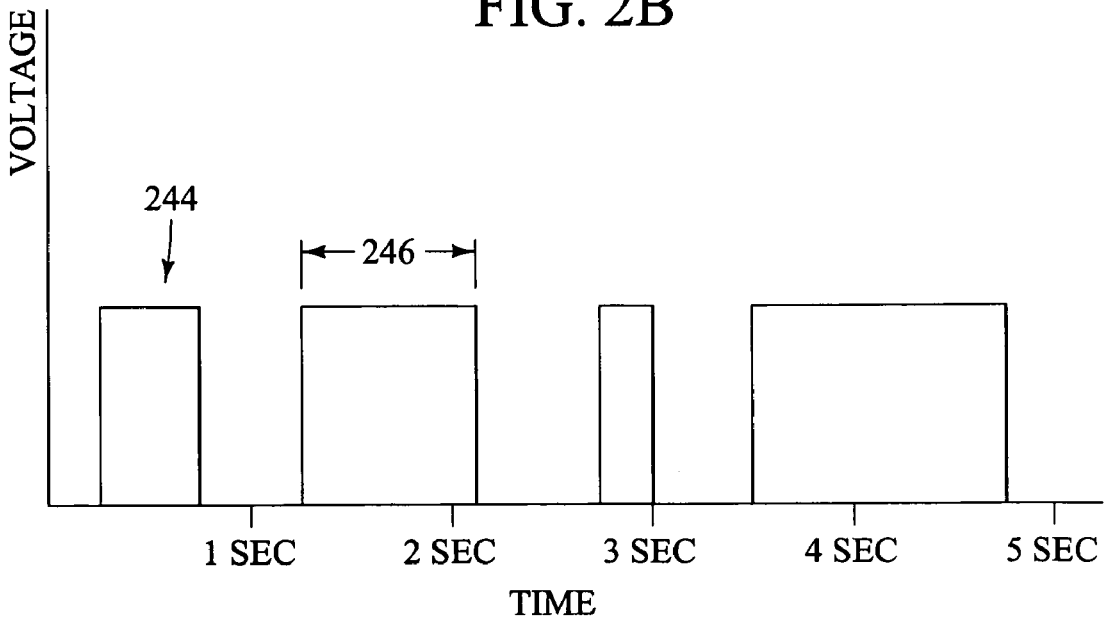

FREQUENCY CONTROLLED LIGHTING SYSTEM

FIELD OF THE INVENTION

The present invention relates generally to clothing and accessories, and more particularly to an improved system for illuminating devices incorporated into clothing and accessories.

BACKGROUND

Lighting systems have been incorporated into footwear, generating distinctive flashing lights when a person wearing the footwear walks or runs. These systems generally have an inertia switch, so that when the heel of a runner strikes the pavement, the switch activates the flashing light system. The resulting light flashes are useful in identifying the runner, or at least the presence of the runner, due to the easy-to-see nature of the flashing lights.

These lighting systems, however, suffer from a number of deficiencies. There is typically no on-off switch for the lighting system, and thus the system is "on" all the time, draining the power source, which is typically a small battery. Even if the only portion of the system that is operating is an oscillator or timer, the power drain over time is cumulative, this leading to shorter-than-desirable battery life. It would be desirable to have some other means for turning the lighting system on or off, especially through the use of an external motion.

Another deficiency is that many flashing or intermittent light systems only have one light pattern. While one light pattern makes the user more visible, there is no provision for varying or making the pattern interesting dependent on the type of movement of the user. It would be desirable to have some system for activating different light patterns depending on the type of movement of the user. The present invention is directed at correcting these deficiencies in the prior art.

BRIEF SUMMARY

One embodiment of the invention provides a frequency controlled lighting system which includes a motion switch, a controller, and lighting elements. Generally, the motion switch generates an activation signal in response to movement of the motion switch which indicates at least one of the duration and frequency of electrical engagement within the motion switch. The controller detects the activation signal produced by the motion switch and illuminates the lighting elements in one or more predetermined illumination patterns dependant on the duration and frequency of electrical engagement within the motion switch.

Another embodiment of the invention provides a method for illuminating a series of lighting elements. First an activation signal is created based on the movement of a motion switch. Based on the activation signal, a duration of electrical engagement and a frequency of electrical engagement within the motion switch for a period of time is determined. In response to activation of the motion switch, at least one of a series of lighting elements is illuminated. Finally, the duration of electrical engagement is compared to a predetermined duration level to determine an illumination pattern for the series of lighting elements and the frequency of electrical engagement within the motion switch is compared to a predetermined frequency threshold to adjust the illumination pattern of the series of lighting elements.

Yet another embodiment of the invention provides another frequency controlled lighting system including a motion switch, a controller, and lighting elements. The motion switch generates an activation signal in response to movement of the motion switch due to the electrical engagement of a free end of a spring and a metal contact. The controller detects the activation signal and a signal analysis system within the controller analyzes the activation signal to command a pattern generator to illuminate the lighting elements in one or more predetermined lighting patterns.

BRIEF DESCRIPTION OF THE DRAWINGS

FIG. 2*a* is a schematic of a spring motion switch;

FIG. 2*b* is a diagram of an activation signal generated within the motion switch of FIG. 2*a;*

DETAILED DESCRIPTION OF THE DRAWINGS AND THE PRESENTLY PREFERRED EMBODIMENTS

Figure 1:
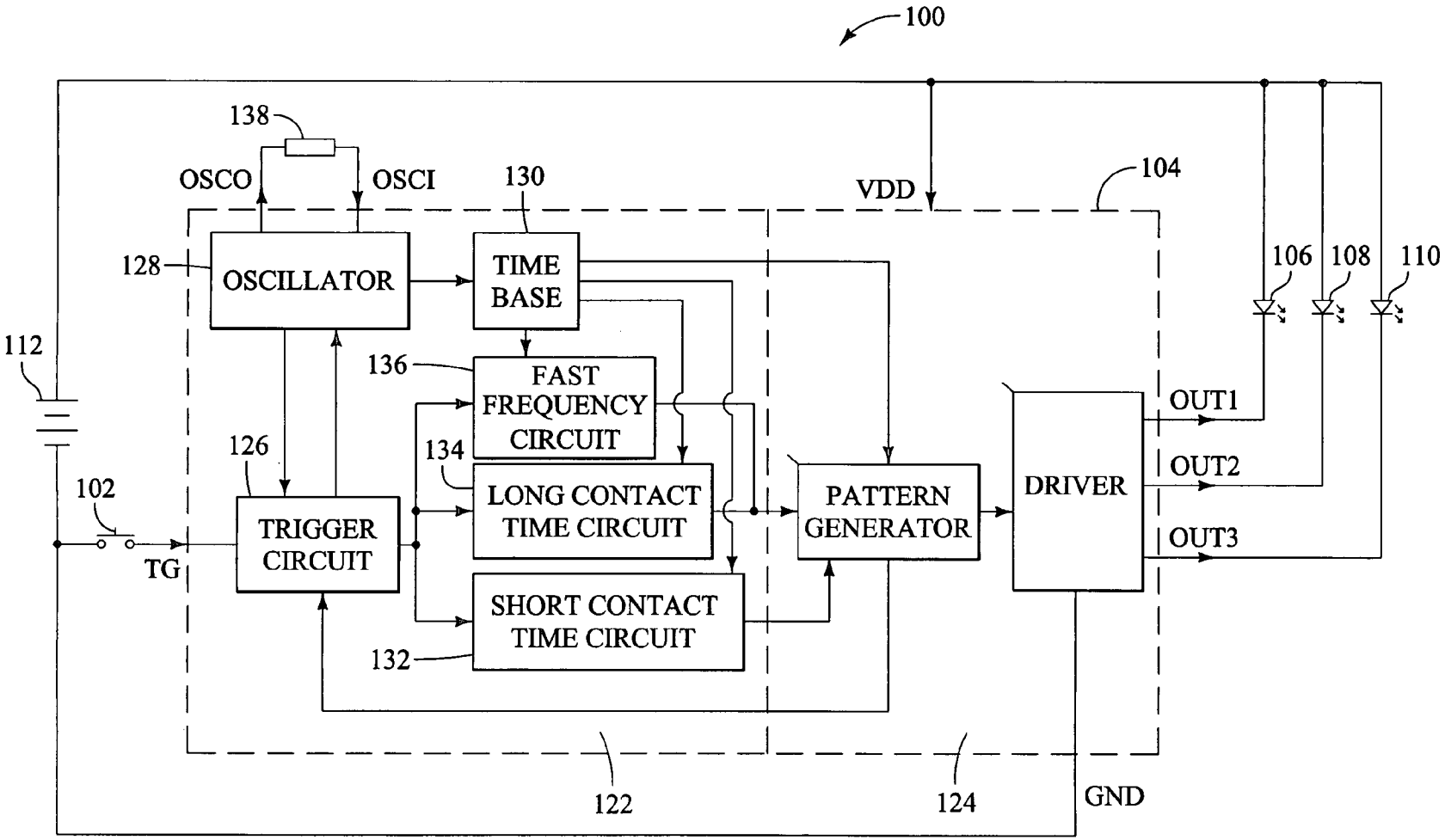
FIG. 1 is a block diagram of a frequency controlled lighting system in accordance with one embodiment of the current invention.

As shown in FIG. 1, a frequency controlled lighting system 100 generally includes a motion switch 102, a controller 104, and a series of lighting elements 106, 108, and 110. In general, movement of the motion switch 102 triggers the controller 104. The controller 104 analyzes the movement of the motion switch 102, and in response to that general movement, illuminates the series of lighting elements 106, 108, and 110 in one or more predetermined patterns. In one exemplary embodiment, the frequency controlled lighting system 100 is incorporated in a shoe or other footwear. The controller 104 and motion switch 102 are contained, for example, in a hollow portion of the shoe sole and the lighting elements 106, 108, 110 are positioned along sides of the shoe for maximum visibility.

Preferably the motion switch 102 is an inertia switch such as a spring motion switch, but any motion switch 102 known in the art can be used. FIG. 2*a* is an exemplary embodiment of a spring motion switch 200 suitable for use in the frequency controlled lighting system 100 of FIG. 1. The spring motion switch 200 is shown in cross section. As shown in FIG. 2*a*, in a preferred embodiment, the spring motion switch 200 includes a spring 214 and a contact 216. The spring 214 is generally made of electrically conductive material such as metal wire wrapped in a cylindrical shape and is positioned within the spring motion switch 200 to have a fixed end 218 and a free end 220. The free end 220 of the spring 214 is positioned proximate the contact 216 so that the free end 220 of the spring 214 electrically engages the contact 216 during movement of the motion switch 200. One suitable spring motion switch 200 including a spring 214 and a contact 216, with a free end 220 of the spring positioned proximate the contact 216 for electrical engagement during movement of the switch 200 is described in U.S. patent application Ser. No. 10/100,621, filed Mar. 18, 2002 and commonly assigned to the owner of the present application, which application is hereby incorporated by reference.

Preferably the spring 214 within the motion switch 200 moves between two general positions. In a first position illustrated in FIG. 2*a*, the free end 220 of the spring 214 is a sufficient distance from the contact 216 so that an electric current cannot pass between the spring 214 and the contact 216, creating an open circuit through the motion switch 200. The spring is normally in the first position when the motion switch 200 is stationary.

In a second position, the free end 220 of the spring 214 bends so that it electrically engages the contact 216, creating a closed circuit in the motion switch 200 between the free end 220 of the spring 214 and the contact 216 so that, if an appropriate bias voltage is applied, an electric current can pass through the motion switch 200. The motion switch 200 is normally in the second position at different points during movement of the motion switch 200.

The periodically closed circuit within the motion switch 200 due to the movement of the free end 220 of spring 214 between the first and second position creates an activation signal. As seen in FIG. 2*b*, the activation signal consists of at least one pulse 244 of voltage or current indicating that the motion switch 200 has been activated. Preferably, the length of the pulse 246 is directly related to the duration of electrical engagement between the free end 220 of the spring 214 and the contact 216. Additionally, the activation signal preferably represents the frequency of electrical engagement by the number of times the free end 220 of the spring 214 electrically engages the contact 216 in a period of time. For example, in FIG. 2*b* there are four pulses in 5 seconds. This represents the free end 220 of the spring 214 electrically engaging the contact 216 four times within 5 seconds. It is this activation signal that the motion switch 200 provides to the controller 104 when the motion switch 200 is activated. The frequency of electrical engagement directly relates to the frequency of external motion of the user. Preferably, the frequency of electrical engagement is re-calibrated by the controller to determine an accurate motion frequency using a factor dependant on the type of motion switch used. For example, if a one-way motion switch is used, the controller uses a factor of one so that the frequency of electrical engagement is the frequency of external motion of the user. If a two-way motion switch is used, the controller uses a factor of two so that the frequency of electrical engagement is dived by two to determine an accurate frequency of external motion of the user.

A one-way motion switch is a motion switch where the contact 216 is positioned such that electrical engagement with the free end 220 of the spring 214 is only possible when the free end 220 of the spring 214 travels in one direction of movement. A two-way motion switch is a motion switch where the contact 216 is positioned such that electrical engagement with the free end 220 of the spring 214 is possible when the free end 220 of the spring 214 travels in either of two directions of movement.

In additional embodiments, the motion switch 102 (FIG. 1) could also be a magnetic reed switch (not shown) or a metal ball motion switch (not shown). If a well-known magnetic reed switch is used, at least two magnetic contacts having a free end and a fixed end are positioned proximate an external magnet so that the free ends of the metal contacts electrically engage due to the magnetic flux of the external magnet during movement of the switch. Preferably, the external magnet is placed in a specially designed housing to hold the magnet. If the magnet is placed at the shoe to sense external motion, the housing should retain a space to allow the magnet to move along its axis. If the magnet is placed outside the shoe, the magnet should be fixed in the specially designed plastic housing so as to allow the user to move the magnet near the reed switch to generate a signal to actuate to integrated circuits. The magnetic reed switch generates a similar activation signal to that of the spring motion switch 102 illustrated in FIG. 2 where current does not flow through the magnetic reed switch when the switch is stationary, but during movement, due to periodic electrical engagement of the contacts, an activation signal is created having properties of duration of electrical engagement and frequency of electrical engagement for a period of time. It should also be noted that, as will be described below in greater detail in connection with FIG. 3, additional motion switches 342 can be added to the frequency controlled lighting system 300 so that the system 300 operates in response to movement of different parts of an object.

Referring again to FIG. 1, the controller 104 in the illustrated embodiment includes a signal analysis system 122 and a pattern generator 124. In general, the signal analysis system 122 analyzes the activation signal which the controller 104 detects from the motion switch 102. In particular, the signal analysis system 122 preferably determines the duration of electrical engagement within the switch 102 from each pulse in the activation signal, and determines the frequency of electrical engagement of the switch for a given period of time. In response to the duration of each electrical engagement and the frequency of electrical engagement, the signal analysis system 122 commands the pattern generator 124 to illuminate the lighting elements 106, 108, and 110 in one or more predetermined lighting patterns.

In one embodiment, the signal analysis system 122 includes a trigger circuit 126, an oscillator 128, a time-base 130, a short contact circuit 132, a long contact circuit 134, and a fast frequency circuit 136. Initially, the trigger circuit 126 receives the activation signal from the motion switch 102. In response, the trigger circuit 126 actuates the oscillator 128, the short contact circuit 130, the long contact circuit 132, the fast frequency circuit 134, and the pattern generator 136. When activated, the oscillator 128 creates a frequency signal with a time period dependant on an oscillation resistor 138. The oscillator resistor 138 can be modified to any value to adjust the frequency signal. The oscillator 128 passes the frequency signal to the time-base 130, which creates a timing signal dependent on the time period of the frequency signal to control the timing of the short contact circuit 132, long contact circuit 134, fast frequency circuit 136, and pattern generator 124.

At generally the same time that the time-base 130 signals the short contact circuit 132, long contact circuit 134, and fast frequency circuit 136, the trigger circuit 126 passes the activation signal to the short contact circuit 132, long contact circuit 134, and fast frequency circuit 136 for examination of the activation signal. Specifically, the short contact circuit 132 examines each pulse within the activation signal to determine whether the pulse length, and therefore the duration of electrical engagement within the motion switch 102, is less than or equal to a predetermined duration level. The predetermined duration level may be any length of time desired by the frequency controlled lighting system designer, but preferably, the duration level is set to be the same time period as the on-time of an LED during flashing. For example, in one embodiment, the predetermined duration level is set to 16 ms. If the short contact circuit 132 determines that the pulse length is equal to or less than the predetermined duration level, the short contact circuit 132 produces a short contact signal.

The long contact circuit 134 examines each pulse within the activation signal to determine whether the duration of electrical engagement is greater than the predetermined duration level. If the long contact circuit 134 determines that the pulse length is greater than the predetermined duration level, the long contact circuit 134 produces a long contact signal. The predetermined duration of the long contact circuit 134 may be the same as or different from the predetermined duration of the short contact circuit 132.

The fast frequency circuit 136 examines the number of pulses in the activation signal within a period of time. If the fast frequency circuit 136 determines that the number of pulses in the activation signal for the period of time is above a predetermined frequency threshold, the fast frequency circuit produces a fast frequency signal. The fast frequency threshold can be any frequency limit desired by the frequency controlled lighting system designer, but preferably, the fast frequency threshold is between 5 Hz and 3 KHz.

Preferably, the pattern generator 124 creates different types of lighting patterns in response to detecting the short contact signal, long contact signal, and fast frequency signal. The pattern generator 124 can be programmed or arranged to react differently to any of these signals, but preferably, the pattern generator 124 is programmed to illuminate the lighting elements 106, 108, and 110 in one or more different predetermined lighting sequences each time the short contact circuit 132 signals the pattern generator 124. Further, the pattern generator 124 is preferably programmed to interrupt the lighting sequence and illuminate one lighting element when signaled by the long contact circuit 134 or fast frequency circuit 136. Preferably, the pattern generator 124 continues to illuminate the single lighting element until the long contact signal or the fast frequency signal ceases.

Figure 3:
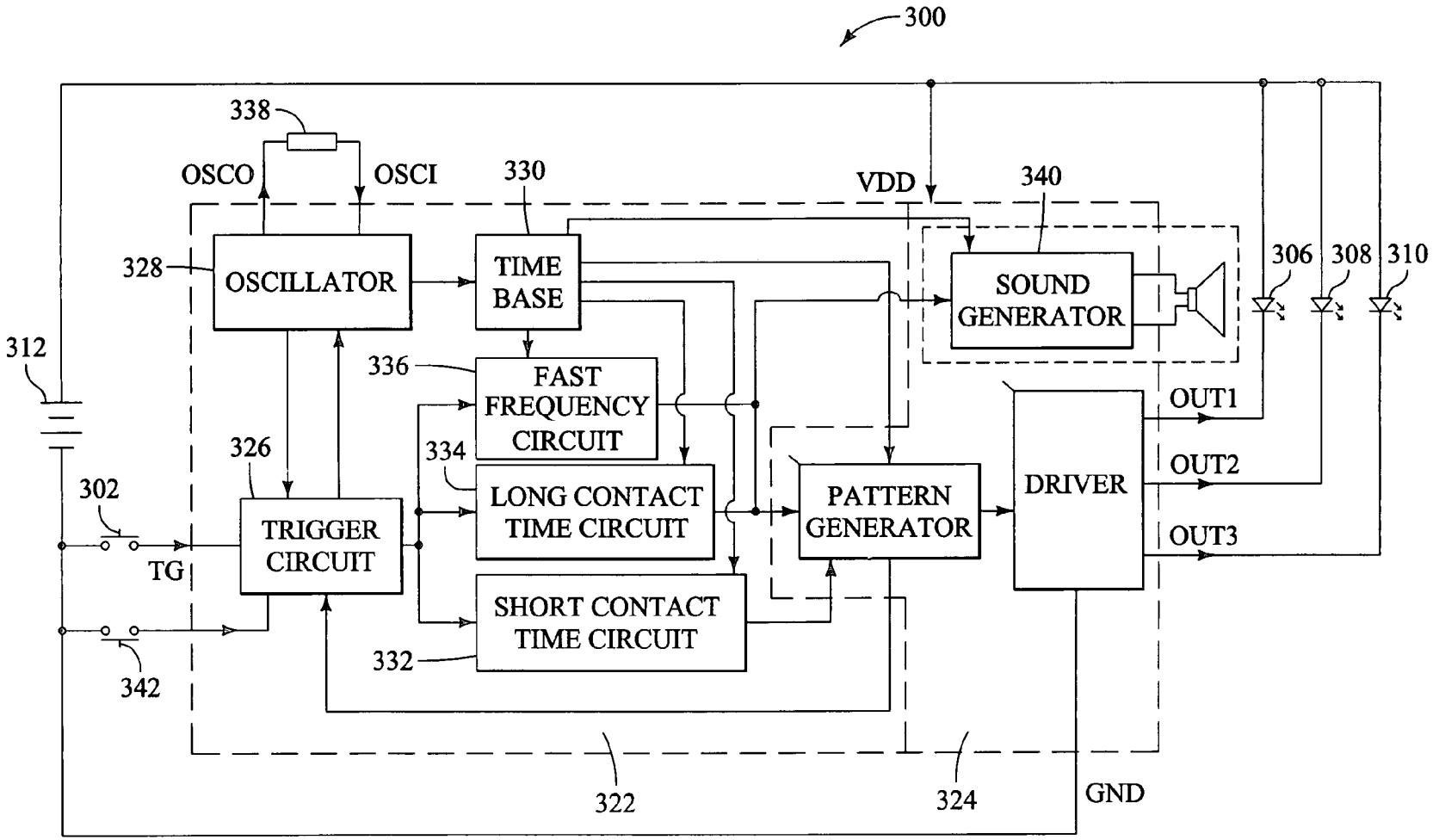
FIG. 3 is a block diagram of a second embodiment of the frequency controlled lighting system which includes a sound generating device.

As seen in FIG. 3, in another embodiment the pattern generator 324 can be programmed to perform functions in addition to illuminating lighting elements 306, 308, and 310 such as actuating a sound generating device 340. The sound generating device 340 can be any sound generating device known in the art such as a speaker generating a voice or music, a transducer, or a simple buzzer. Preferably, a sound generating device 340 is actuated when the pattern generator 324 receives a long contact signal or a fast frequency signal, and the sound generating device 340 continues to operate until the long contact signal or fast frequency signal ceases. Other components of FIG. 3 match the components of FIG. 1.

Figure 4:
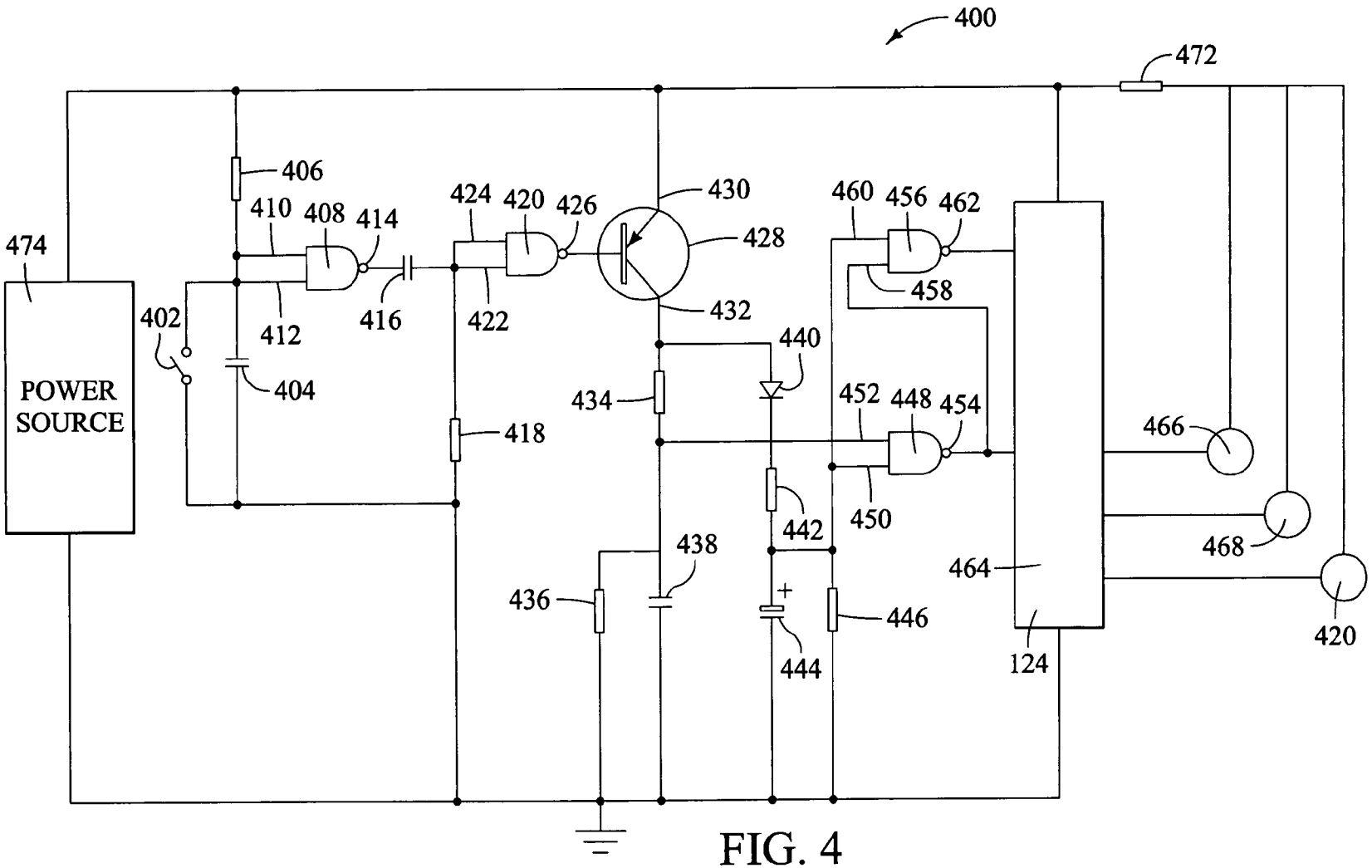
FIG. 4 is a circuit diagram of one embodiment of the frequency controlled lighting system.

An exemplary circuit illustrating one embodiment of a frequency controlled lighting system is shown in FIG. 4. In this embodiment, the trigger circuit 126, oscillator 128, time-base 130, short contact circuit 132, long contact circuit 134, and fast frequency circuit 136 (FIG. 1) are implemented through resistors 406, 418, 434, 436, 442, and 446; capacitors 404, 416, 438, and 444; NAND gates 408, 424, 448, and 456; a diode 440; and a transistor 428. Additionally, the pattern generator 124 is implemented through an integrated circuit 464.

The pattern generator 124 may be any number of integrated circuits suitable for controlling the flashing of the lighting elements 466, 468, and 470 in the system 400. One example of such an integrated circuit, manufactured with CMOS technology for one-time programmnable, read-only memory, is Model No. EM78P153S, made by EMC Corp., Taipei, Taiwan. Other examples of integrated circuits include MC14017BCP and CD4107AF, made by many manufacturers; custom or application specific integrated circuits; CMOS circuits, such as a CMOS 8560 circuit; or M1320 and M1389 RC integrated circuits made by MOS-design Semiconductor Corp., Taipei, Taiwan.

Generally, motion switch 402, resistor 406, and capacitor 404 connect to the inputs 410, 412 of NAND gate 408. Resistor 406 connects between the power source 474 and the inputs 410, 412 of NAND gate 408 while the motion switch 402 and capacitor 404 connect between the inputs 410, 412 of NAND gate 408 and ground. The output 414 of NAND gate 408 connects to capacitor 416, which connects to the inputs 422, 424 of NAND gate 420. Resistor 418 also connects between the inputs 410, 412 of NAND gate 408 and ground. The output of NAND gate 420 connects to the base 426 of transistor 428, while the emitter 430 of transistor 428 connects to the power supply 474. The collector of transistor 432 connects to ground via a resistor-capacitor combination consisting of resistor 434, resistor 436, and capacitor 438. The common node between resistor 434, resistor 436, and capacitor 438 additionally connects to input 452 of NAND gate 448.

The collector of transistor 428 also connects to ground via diode 440, resistor 442, and capacitor 444. The common node between resistor 442 and capacitor 444 connects to input 450 of NAND gate 448. Resistor 446 connects between input 450 of NAND gate 446 and ground. Input 460 to NAND gate 456 also connects to input 450 of NAND gate 448 while input 458 to NAND gate 456 connects to the output of NAND gate 448. The outputs to NAND gates 448 and 456 connect to the pattern generator 464, which additionally connects to the power supply 474 and the lighting elements 466, 468, and 470.

Before operation of the frequency controlled lighting system 400, the inputs 410, 412 to NAND gate 408 are biased to a high voltage state. The high inputs at NAND gate 408 result in a low output at NAND gate 408, forcing the inputs of NAND gate 420 to a low voltage state. The low voltage of the inputs 420, 424 to NAND gate 420 result in a high output at the base of transistor 428. Therefore, due to the fact there is not a sufficient voltage drop across the transistor, the transistor 428 does not conduct and no current passes through transistor 428. For this reason, capacitors 438 and 444 do not charge and over time fully dissipate any charge stored in the capacitors over resistor 436 or resistor 446. Thus, input 460 of NAND gate 456 and the inputs of NAND gate 448 are low dictating the output of NAND gate 456 and NAND gate 448 to be at a high state before operation of the frequency controlled lighting system.

During movement of the motion switch 402 in the preferred embodiment, the switch 402 produces a signal as a result of the free end 220 of the spring 214 electrically engaging the metal contact 216. The electrical engagement of the spring 214 and the contact 216 creates a closed circuit, allowing current to flow through the motion switch 402 and force the inputs of NAND gate 408 to change from high to low. The change in voltage state of the inputs to NAND gate 408 results in the output of NAND gate 408, and therefore the inputs of NAND gate 420, to change from low to high. The change in voltage state of the inputs to NAND gate 420 force the output of NAND gate 420 to low.

Since the output of NAND gate 420 is connected to the base of transistor 428, as the base voltage of transistor 428 goes from high to low, transistor 428 begins conducting. As current flows through transistor 428, capacitor 438 begins charging through resistor 434 and discharging through resistor 436. Preferably, resistor 434 is larger than resistors 436 and 442 so that capacitor 438 does not charge to a high enough level to change the voltage state of input terminal 452 of NAND gate 448 from low to high during a short electrical engagement within the motion switch 402.

As current flows through transistor 428, capacitor 444 also charges. Preferably, capacitor 444 charges to a high level, causing input terminal 450 to NAND gate 448 and input terminal 460 to NAND gate 456 to change from low to high. Therefore, due to the fact input terminal 452 to NAND gate 448 remains low and input terminal 450 to NAND gate 448 changes from low to high, the output of NAND gate 448 remains high. Further, since input terminal 460 to NAND gate 456 changes from low to high and input terminal 458 to NAND gate 456 remains high, the output of NAND gate 456 changes from high to low. This change in output from NAND gate 456 signals the pattern generator 464 to actuate the lighting elements 466, 468, and 470 in a predetermined flashing pattern. The output of NAND gate 448 at a high voltage state while the output of NAND gate 456 is at a low voltage state is the short contact signal.

Preferably, the pattern generator 464 is programmed to illuminate the lighting elements 466, 468, and 470 in a different pattern each time it receives the short contact signal. For example, if the lighting elements 466, 468, and 470 are outputs 1, 2, and 3, the first time the pattern generator 464 receives the short contact signal it illuminates the lights in the sequence 1-2-3-1-2-3-1-2-3 where the number 1, 2, and 3 refer to LEDs 466, 468, and 470 respectively. The second time the pattern generator 464 receives the short contact signal it illuminates the lights in the sequence 2-3-1-2-3-1-2-3-1. The third time the pattern generator 464 receives the short contact signal it illuminates the lights in the sequence 3-1-2-3-1-2-3-1-2. The pattern generator 464 continues illuminating the lighting elements 466, 468, and 470 in different patterns each time it receives a short contact signal.

During production of the predetermined flashing pattern, if the motion switch 402 closes for a long duration such as 16 ms, or the motion switches closes a large number of times in a short time period, such as five times in one second, the inputs to NAND gate 408 change from high to low for a long period of time, resulting in the output of NAND gate 408 changing from low to high for a long period of time. Due to the change in output of NAND gate 408, the inputs to NAND gate 420 again change from low to high, causing the output to NAND gate 420 to change to low. Since the base of transistor 428 is connected to the output of NAND gate 420, transistor 428 starts conducting. Transistor 428 conducts for a large period of time due to the long duration of electrical engagement within the motion switch or the high frequency of electrical engagement within the switch 402. Therefore, capacitors 438 and 444, which charge when current flows through transistor 428, are able to store a relatively high charge and establish a relatively high voltage drop between ground and input 452 of NAND gate 448. The high charge of capacitor 438 forces input terminal 452 of NAND gate 148 to high. Additionally, the high charge of capacitor 444 forces input terminal 450 to NAND gate 448 and input terminal 460 to NAND gate 456 to high.

The change in the voltage state of the input terminals to NAND gate 448 drives the output of NAND gate 448 to low. Due to this change in the output of NAND gate 448, input terminal 458 to NAND gate 456 also changes from high to low, resulting in the output of NAND gate 456 changing to high. The change in outputs of NAND gates 448 and 456 signals the pattern generator 464 to freeze any current flashing pattern of the pattern generator 464. Preferably, the output of the pattern generator 464 is frozen until capacitors 438 and 444 discharge to a low enough level that NAND gates 448 and 456 return to their standby state of high. The output of NAND gate 448 being at a low voltage state while the output of NAND gate 456 is at a high voltage state is the long contact signal or the fast frequency signal.

Figure 5:
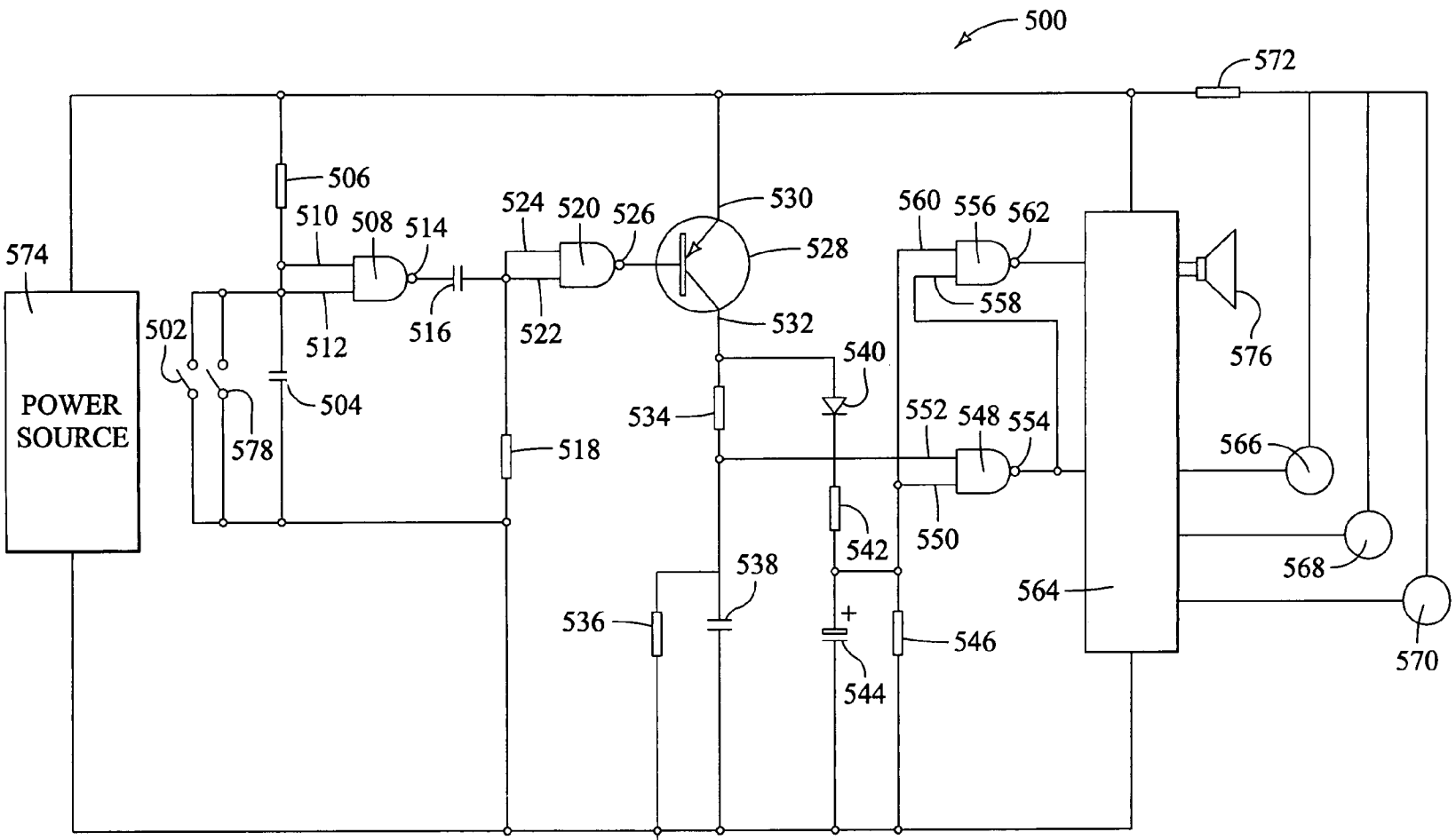
FIG. 5 is a circuit diagram of another embodiment of the frequency controlled lighting system which includes a sound generating device.

In another embodiment, the circuit shown in FIG. 4 can be modified with a sound generating device 576 as shown in FIG. 5. In this embodiment, the pattern generator 564 actuates the sound generating device 576 when the pattern generator 564 receives a long contact signal or a fast frequency signal. The sounds generating device 576 may include any suitable combination of circuitry to respond to actuating signals from the pattern generator 564 by producing sound. The sound generating device 576 may also include a speaker, transducer or other electromechanical device for producing sound. Preferably, the sound generating device continues to produce sound until the long contact signal or fast frequency signal ceases.

Figure 6:
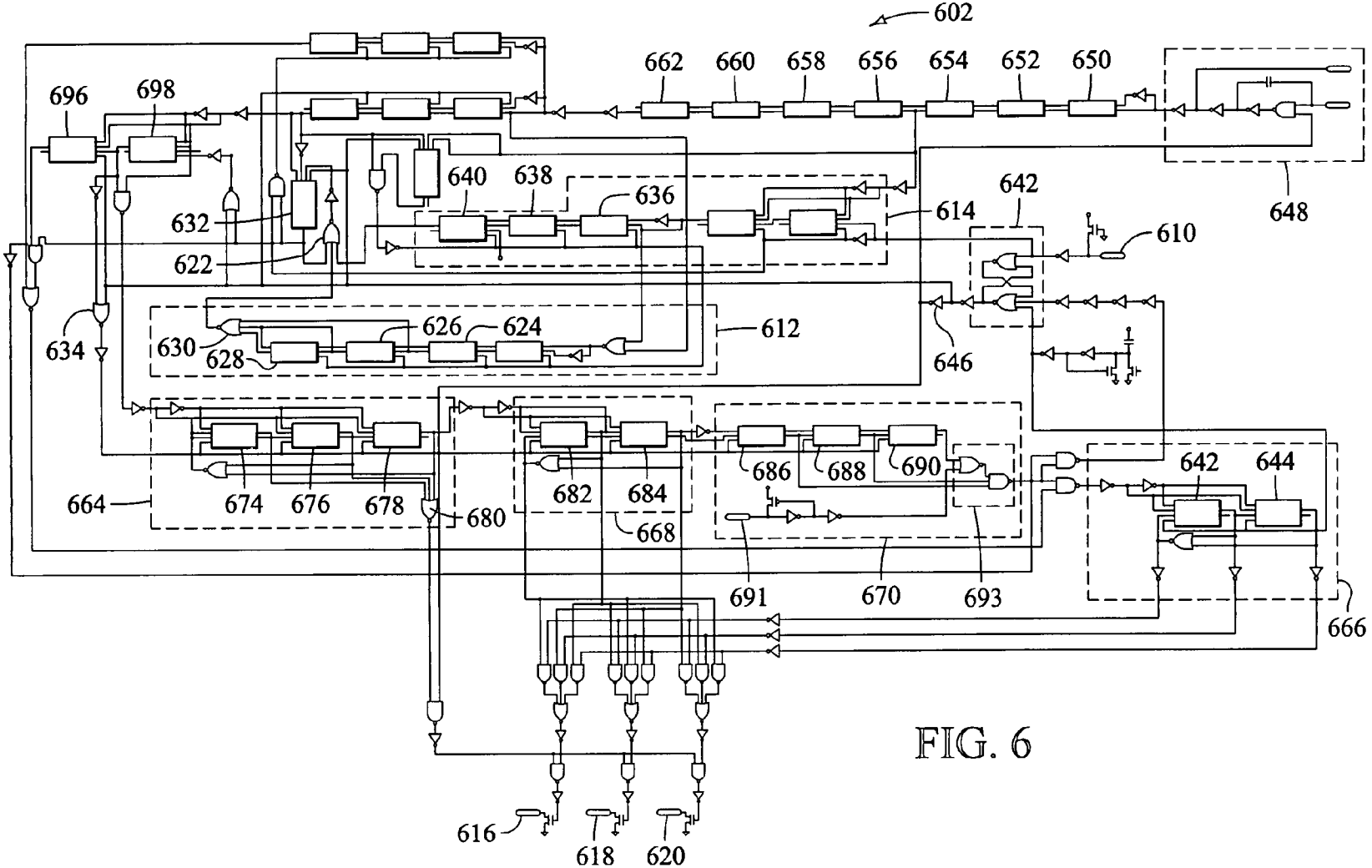
FIG. 6 is a circuit diagram of another embodiment of the frequency controlled lighting system implemented by a CMOS circuit.

Another embodiment of one aspect of the invention is a CMOS circuit 602 shown in FIG. 6. The CMOS circuit 602 includes flip-flops, logic gates, capacitors, and transistors. In general, the CMOS circuit 602 includes three stages 604, 606, and 608. The first stage 604 receives the activation signal generated by the motion switch 610. The second stage 606 analyzes the activation signal. Finally, the third stage 608 illuminates the LEDs 616, 618, and 620. In general, the first stage 604 is connected to the second stage 606 so that the activation signal passes to the long duration circuit 612 and the fast frequency circuit 614 of the second stage 606. The output of the long duration circuit 612 and the fast frequency circuit 614 are passed to NOR gate 622, which signals the third stage 608 if a long duration signal or a fast frequency signal is created. If the third stage 608 does not detect this indication from NOR gate 622 after the activation signal triggers the system 600, the third stage 608 creates a lighting pattern to illuminate the LEDs 616, 618, and 620.

Preferably, the first stage 604 generally includes the motion switch 610, an RS flip-flop 642, at least one NOR gate 646, an RC oscillating circuit 648, and a series of flip-flops 650, 652, 654, 656, 658, 660, and 662. In general, the RS flip-flop 642 is connected to the motion switch 610 such that when there is movement in the motion switch 610, the output of the RS flip-flop 642 changes to high. The change in output of the RS flip-flop 642 causes NOR gate 646 to change voltage state, thereby causing the RC oscillating circuit 648 to begin producing a periodic signal. The signal may have any frequency but preferably the signal has a frequency of 64 kHz.

The periodic signal from RC oscillating circuit 648 passes to flip-flops 650, 652, 654, 656, 658, 660, and 662. Preferably, flip-flops 650, 652, 654, 656, 658, 660, and 662 are connected in series to count down the periodic signal produced by RC oscillating circuit 648. As the periodic signal is counted down the series of flip-flops, the signal passes to various parts of the CMOS circuit 602 to act as a clock.

The second stage 606 acts to analyze the activation signal from the motion switch 610 and generally includes a long duration circuit 612 and a fast frequency circuit 614. Preferably, the long duration circuit 612 includes at least three flip-flops 624, 626, and 628 connected in series and configured to track the duration of electrical engagement represented in the activation signal. Each output of flip-flops 624, 626, and 628 connect to a separate input of three-input NOR gate 630. Therefore, when all three inputs to NOR gate 630 are low, indicating electrical engagement within the motion switch at consecutive periods of time, the output of NOR gate 630 changes to high.

Since the output of NOR gate 630 connects to one of the inputs of NOR gate 622, the change in output of NOR gate 630 drives the output of NOR gate 622 to low. This change in voltage state of the output of NOR gate 622 changes the output of flip-flop 632, which changes the output of NAND gate 634 to low. The output of NAND gate 634 changing to low signals the third stage 608 to freeze any flashing pattern.

Preferably, the fast frequency circuit 614 generally includes at least three flip-flops 636, 638, and 640, which are configured to track the frequency of electrical engagement in the motion switch 610. In general, the at least three flip-flops 636, 638, and 640 are cleared whenever the frequency of electrical engagement is below a predetermined threshold. If flip-flops 636, 638, and 640 are not cleared within a given number of clock cycles, flip-flop 640 outputs a high signal. Due to the fact that the output of flip-flop 640 connects to one of the inputs of NOR gate 622, the output of NOR gate 622 changes to low when the output of flip-flop 640 is high. As discussed with respect to the long duration signal, when the output of NOR gate 622 changes to low, the output of flip-flop 632 changes to high and the output of NAND gate 634 changes to low, again signaling the third stage 608 to freeze any flashing pattern.

The third stage 608 generally includes a number of circuits which control the flashing patterns of LEDs 616, 618, and 620. Preferably, the third stage 608 includes a single illumination control 664, a starting LED control 666, a sequential lighting control 668, a short duration flashing control 670, and a long duration or fast frequency flashing control.

The single illumination control 664 operates to illuminate a single LED during illumination patterns. This governs the light on time and light off time of the LEDs. The single illumination control 664 generally includes at least three flip-flops, 674, 676, and 678, and a NOR gate 680. In general, flip-flops 674, 676, and 678 are configured to output a control signal cycling through "000", "100", "110", "011", and "001." The outputs of flip-flops 674, 676, and 678 each connect to a separate input of NOR gate 680 so that NOR gate 680 only generates a high signal when each flip-flop outputs a low signal. The output of NOR gate 680 connects to the circuitry activating LEDs 616, 618, and 620 such that any LED can only be illuminated when the output of NOR gate 680 is high. Therefore, an LED can only illuminate every fifth clock cycle.

The starting LED control 666 operates to illuminate a different LED at the beginning of a flashing pattern in response to an electrical engagement in the motion switch 610 which is less than the predetermine duration level. The starting LED control 666 generally includes at least two flip-flops, 692 and 694. Flip-flops 692 and 694 are configured to output a control signal cycling through "00", "10" and "01." Preferably, flip-flops 692 and 694 operate within the CMOS circuit 602 to cycle to a new control signal state each time a short electrical engagement within the motion switch 610 is detected. Therefore, the signal from the starting LED control 666 will never be the same for two consecutive short electrical engagements within the motion switch 610.

The outputs of the starting LED control 666 is coupled to the circuitry activating LEDs 616, 618, and 620 such that a different LED illuminates at the beginning of an illumination pattern depending on the state of the control signal from the starting LED control 666. Preferably, LED 616 illuminates first in an illumination pattern when the control signal from the starting LED control 666 is "00;" LED 618 illuminates first in an illumination pattern when the control signal from the starting LED control 666 is "10;" and LED 620 illuminates first in an illumination pattern when the control signal from the starting LED control 666 is "01."

The sequential lighting control 668 operates to illuminate LEDs 616, 618, and 620 in a sequential flashing pattern. In general, the sequential lighting control 668 includes at least two flip-flops, 682 and 684. Preferably, flip-flops 682 and 684 are configured to output a control signal cycling through "00", "10" and "01." The sequential lighting control 668 preferably cooperates with the single illumination control 664 such that the control signal of the sequential lighting control 668 cycles to a new state near the same time the single illumination control 664 outputs a "000" signal. The sequential lighting control 668 is coupled to the circuitry which illuminates LEDs 616, 618, and 620 so that the control signal from the sequential lighting control 668 illuminates the LEDs in a sequential pattern, starting with the LED indicated by the starting LED control 666.

The short duration flashing control 670 operates to stop the illumination pattern of LEDs 616, 618, and 620 in response to a short electrical engagement after a predetermined number of cycle states. Preferably, the short duration flashing control 670 generally includes at least three flip-flops 686, 688, and 690; a switch 691; and a series of logic gates 693. In general, flip-flops 686, 688, and 690 and switch 691 are coupled to the series of logic gates 693 such that the short duration flashing control 670 produces a signal when the illumination pattern cycles through a predetermined number of cycle states. Preferably, the short duration flashing control 670 signals that the illumination pattern has cycled through the predetermined number of cycle states by changing from high to low.

Preferably, the number of cycle states that the illumination pattern cycles through before the short duration flashing control 670 produces a signal can be changed through the use of switch 691. In the embodiment shown in FIG. 6, switch 691 is configured to connect the logic gates 693 to a voltage source or ground depending on the state of switch 691. Connecting the logic gates 693 to a voltage source or ground affects the logic cycle of the short duration flashing control 670, thereby changing the number of cycle states the illumination pattern will cycle through before the series of logic gates 693 produces a low signal. For example, in the embodiment shown in FIG. 6, when switch 691 connects the logic gates 693 to ground, the illumination pattern cycles through seven voltage states before the short duration flashing control 670 produces a low signal, and when switch 691 connects the logic gates 693 to the voltage source, the illumination pattern cycles through three voltage states before the short duration flashing control 670 produces a low signal.

The long duration or fast frequency flashing control operates by controlling the outputs of the single illumination control 664, sequential lighting control 668, and short duration flashing control 670 to freeze any flashing pattern and illuminate a single LED in response to a signal from the long duration circuit 612 or the fast frequency circuit 614 of the second stage 606. As discussed above, when the long duration circuit 612 of the second stage 606 detects an electrical engagement which is longer than the predetermined duration level in the motion switch 610 or the fast frequency circuit 614 detects consecutive electrical engagements within the motion switch 610 for a given number of clock cycles, NAND gate 634 changes to low while flip-flops 696 and 698 remain at low. At this time, a clock signal does not pass to the single illumination control 664, forcing the single illumination control 664 to remain constant. Therefore, the sequential lighting control 668 and the short duration flashing control 670 do not cycle through their respective control signals due to their dependence on the single illumination control 672. As a result, LEDs 616, 618, and 620 do not flash and only the LED which is illuminated when the long duration circuit 612 or fast frequency circuit 614 signaled the third stage 608 continues to illuminate until the electrical engagement within the motion switch 610 ends. When the electrical engagement within the motion switch 610 ends, the RC oscillator 642 stops and the illuminated LED extinguishes.

Figure 7:
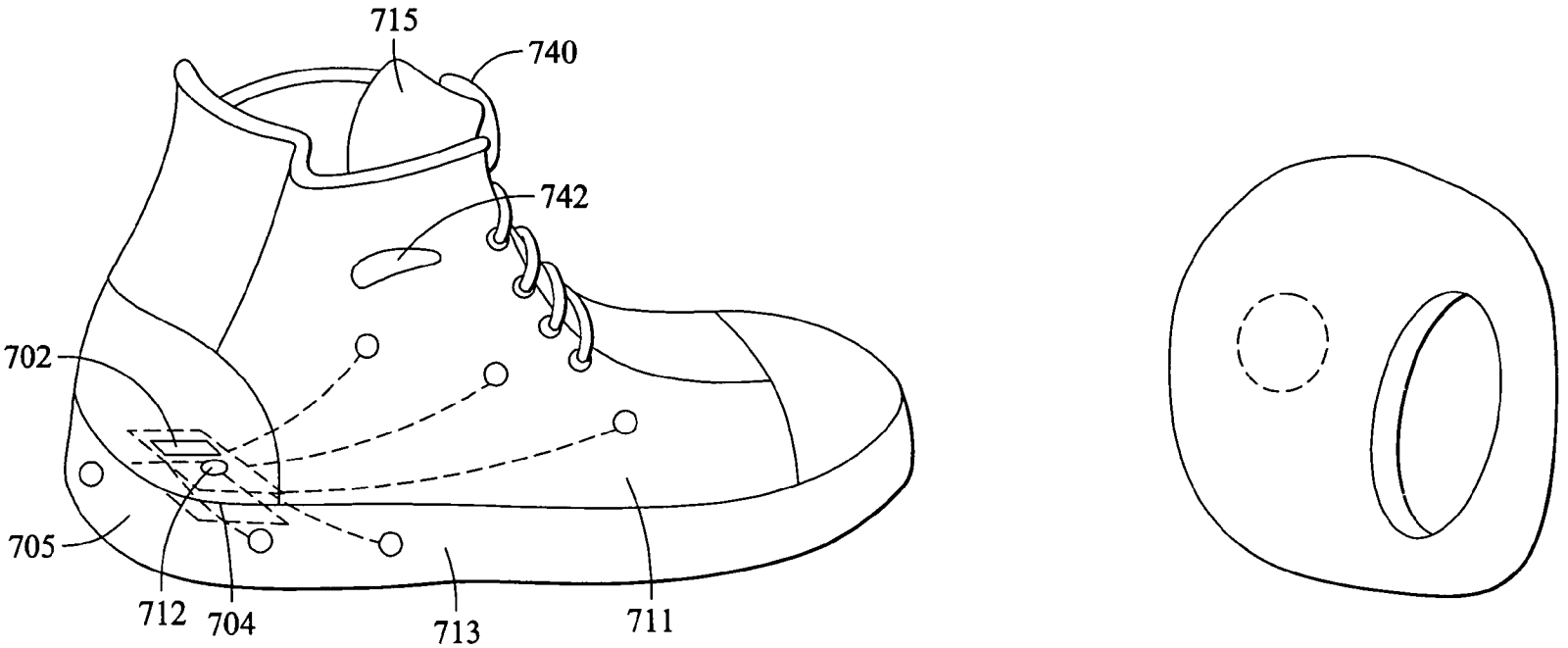
FIG. 7 is a drawing of footwear including the frequency controlled lighting system which shows the preferred placement of components of the frequency controlled lighting system in the footwear.
Figure 8:
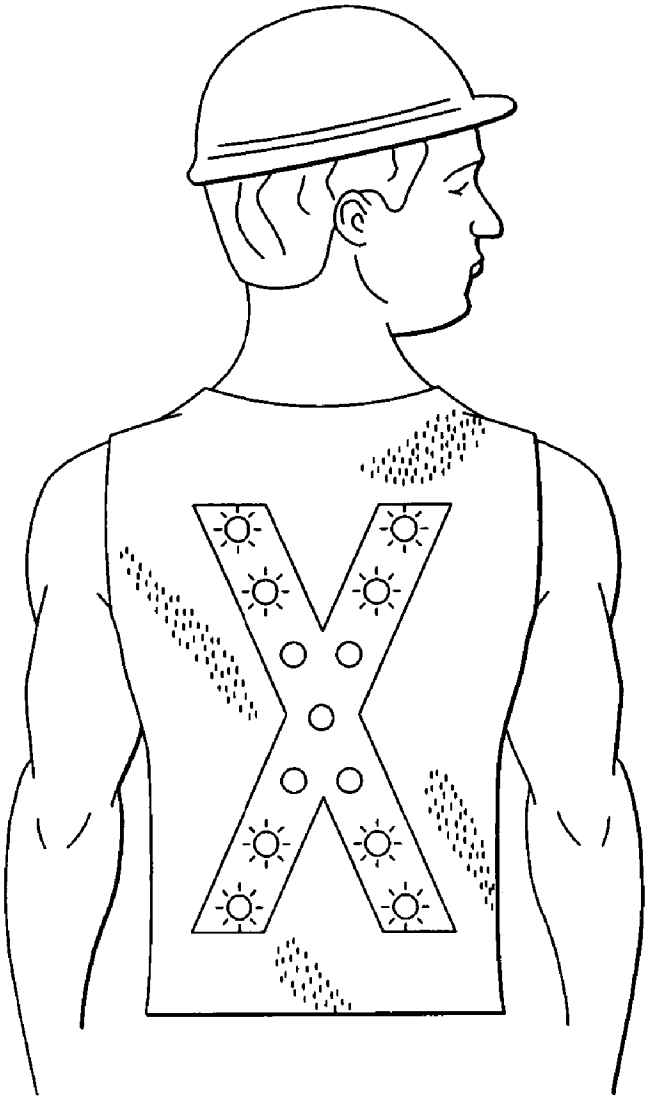
FIG. 8 is a drawing of a safety vest including the frequency controlled lighting system.
Figure 9:
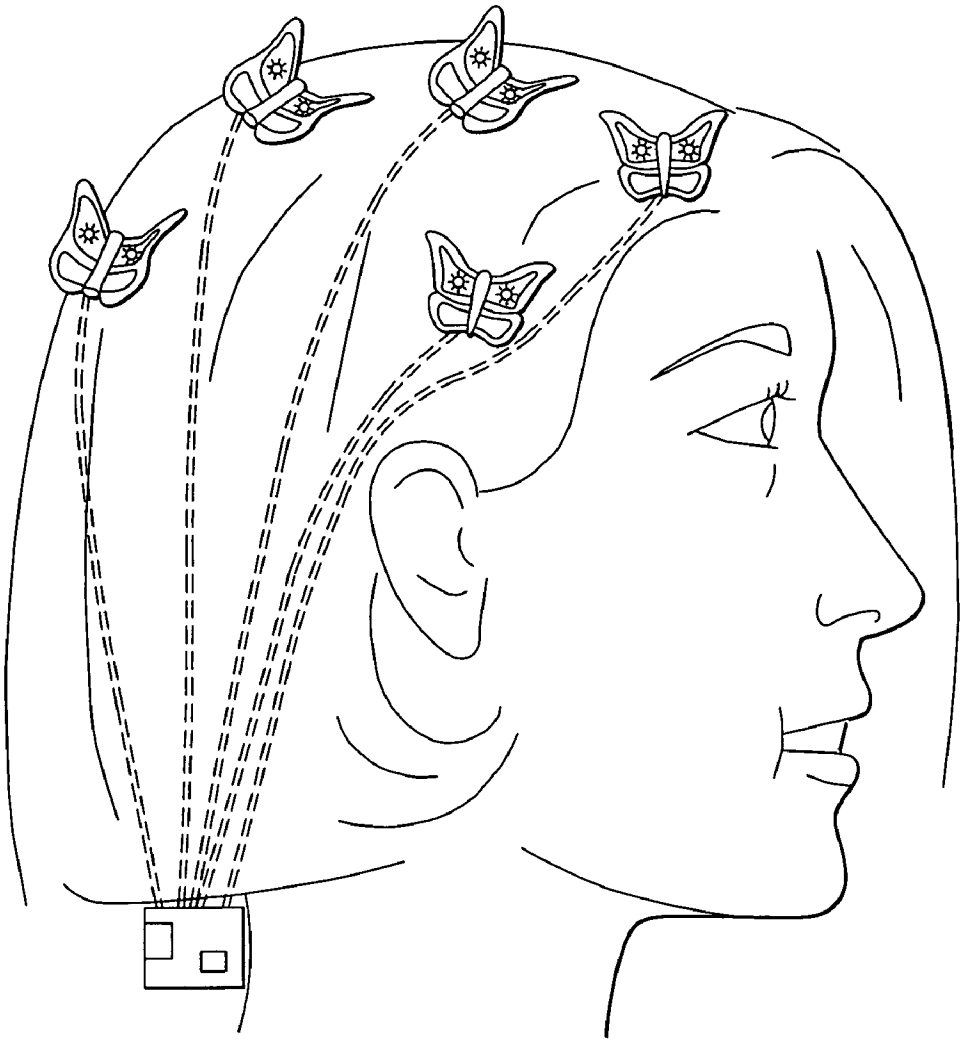
FIG. 9 is a drawing of a set of barrettes including the frequency controlled lighting system.
Figure 10:
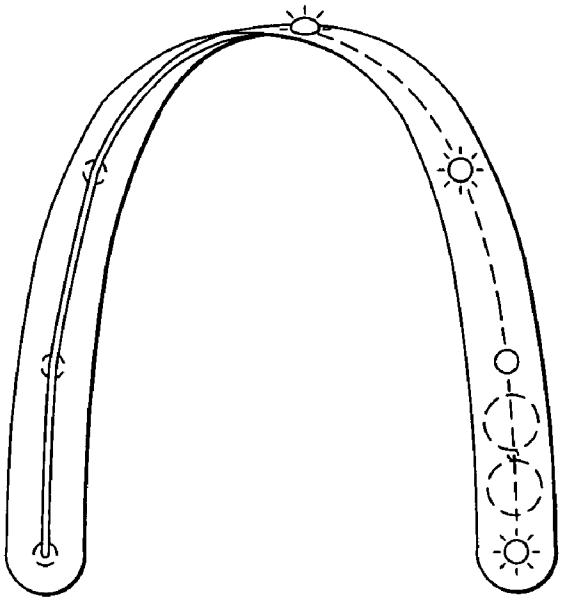
FIG. 10 is a drawing of a headband including the frequency controlled lighting system.

The components of the frequency controlled lighting system 1 can be placed anywhere throughout footwear, but an embodiment having the preferred placement of the components of the system I is shown in FIG. 7. Preferably, the power source 712, the controller 704, and the motion switch 702 are placed in the heel 705 of the footwear. The heel 705 provides a large area to encapsulate the power source 712 and the controller 704. Additionally, during movement such as running or walking, a user normally strikes the heel 705 against the ground with a sufficient force to activate the motion switch 702. The LEDs 706, 708, and 710 are preferably placed on the outer surface 711 of the shoe or the sole 713 of the shoe. Further, the sound generating device 740 is preferably placed on the outer surface 711 of the shoe or the tongue 715 of the shoe.

Figure 11:
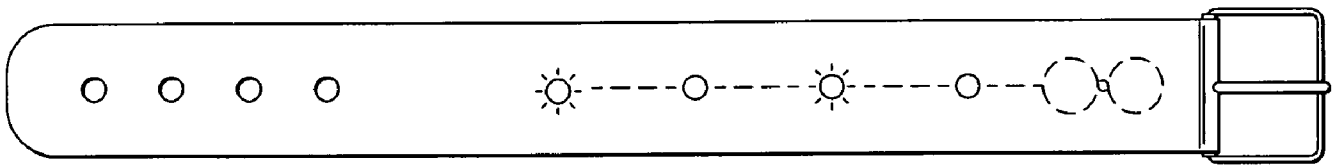
FIG. 11 is a drawing of a bracelet including the frequency controlled lighting system.

As seen in FIGS. 7–11, the frequency controlled lighting system in accordance with the present invention can be incorporated into many objects such as footwear (FIG. 7), a safety vest (FIG. 8), barrettes (FIG. 9), a headband (FIG. 10), or a bracelet (FIG. 11). In all of these objects, the frequency controlled lighting system provides a user greater visibility, thereby providing greater safety and aesthetic value for the user. The lighting system can be integrated into many other objects as well, and FIGS. 7–11 are intended to be exemplary only.

The embodiments described herein overcome issues of previous lighting systems concerning shorter-than-desired battery life due to unnecessary battery drain by allowing a user to deactivate a flashing pattern through external motions. Alleviating unnecessary power drain allows for a long-lasting product, allows for creation of smaller lighting systems, and allows for more complex lighting systems that will not drain a power source as quickly as previous less complex lighting system.

Additionally, the embodiments described herein overcome limitations of previous lighting systems by providing a frequency controlled lighting system creating multiple lighting patterns in various objects in response to movement of the lighting system. Multiple lighting patterns provides greater visibility for the user to increase safety. Additionally, multiple illumination patterns creates a more interesting lighting patterns to increase the aesthetic value of the object.

All the circuits described and many other circuits may be used in achieving the result of a frequency controlled lighting system that illuminates different lighting patterns in response to movement of a motion switch. Additionally, many of the elements of the frequency controlled lighting system may be implemented through a number of objects. For instance, while LEDs are clearly preferred, other types of lamps may also be used, such as incandescent lamps or other lamps. It is therefore intended that the foregoing detailed description be regarded as illustrative rather than limiting, and that it be understood that it is the following claims, including all equivalents, that are intended to define the spirit and scope of this invention. Any of these improvements may be used in combination with other features, whether or not explicitly described as such. Other embodiments are possible within the scope of this invention and will be apparent to those of ordinary skill in the art. Therefore, the invention is not limited to the specific dates, representative embodiments, and illustrated examples in this description.

The invention claimed is:

1. A frequency controlled lighting system comprising:

a motion switch to generate an activation signal in response to movement of the motion switch, the activation signal indicating at least one of duration and frequency of electrical engagement within the motion switch;

a controller electrically connected to the motion switch to receive the activation signal; and lighting elements, electrically connected to the controller, the lighting elements selectively actuated by the controller to illuminate the lighting elements in one or more predetermined illumination patterns dependant on the duration and frequency of electrical engagement indicated by the activation signal;

wherein the controller comprises:

a triggering circuit electrically connected to the motion switch to receive the activation signal, the triggering circuit creating a triggering signal upon reception of the activation signal;

an oscillator, electrically connected to the triggering means to receive the triggering signal, the oscillator creating a frequency signal upon reception of the triggering signal;

a time-base, electrically connected to the oscillator to receive the frequency signal, the time-base creating a timing signal upon reception of the frequency signal;

a short contact circuit, electrically connected to the time-base for receiving the timing signal and electrically connected to the triggering circuit to receive the activation signal, the short contact circuit generating a short contact signal when the duration of electrical engagement is less than or equal to the predetermined duration level;

a long contact circuit, electrically connected to the time-base to receive the timing signal and electrically connected to the triggering circuit to receive the activation signal, the long contact circuit generating a long contact signal when the duration of electrical engagement exceeds the predetermined duration level;

a fast frequency circuit, electrically connected to the time-base to receive the timing signal and electrically connected to the triggering circuit to receive the activation signal, the fast frequency circuit responsive to the activation signal and the timing signal to compare the frequency of electrical engagement to a predetermined frequency threshold and generating a fast frequency signal when the frequency of electrical engagement is above the predetermined frequency threshold; and a pattern generator, electrically connected to the timebase to receive the frequency signal, electrically connected to the short contact circuit to receive the short contact signal, electrically connected to the long contact circuit to receive the long contact signal, electrically connected to the fast frequency circuit to receive the fast frequency signal, and electrically connected to the lighting elements to selectively actuate the lighting elements in one or more of a series of predetermined patterns upon reception of the short contact signal, long contact signal, or fast frequency signal.

2. The frequency controlled lighting system of claim 1 wherein the motion switch is a spring motion switch including a spring having a fixed end and a free end, and a metal contact positioned proximate the free end of the spring for electrical engagement by the free end of the spring.

3. The frequency controlled lighting system of claim 2 wherein the duration of electrical engagement is the duration of time the free end of the spring electrically engages the metal contact.

4. The frequency controlled lighting system of claim 1 wherein the motion switch is a magnetic reed motion switch including at least two contacts having a fixed end and a free end, wherein each contact is made of magnetic material, and an external magnet, positioned proximate the at least two contacts so that during movement of the switch a magnetic field from the external magnet forces the free end of each contact to electrically engage each other.

5. The frequency controlled lighting system of claim 4 wherein the duration of electrical engagement is the duration of time the free end of each contact electrically engage each other.

6. The frequency controlled lighting system of claim 1 wherein the frequency controlled lighting system is located in a piece of footwear such that the controller and motion switch are located in a heel of the piece of footwear and at least one lighting element is located on the outer surface of the footwear.

7. The frequency controlled lighting system of claim 1 wherein the pattern generator illuminates the lighting elements in one or more of the series of predetermined patterns each time the short contact circuit signals the pattern generator with the short contact signal.

8. The frequency controlled lighting system of claim 7 wherein the pattern generator illuminates the lighting elements in a different pattern each time the short contact circuit signals the pattern generator.

9. The frequency controlled lighting system of claim 1 wherein the pattern generator interrupts any flashing pattern and illuminates a single lighting element in response to receiving the long contact signal from the long contact circuit.

10. The frequency controlled lighting system of claim 9 wherein the pattern generator illuminates the single lighting element until the long contact signal ceases.

11. The frequency controlled lighting system of claim 1 further comprising a sound generating device, activated by the pattern generator when the pattern generator interrupts any flashing pattern in response to receiving the long contact signal from the long contact circuit.

12. The frequency controlled lighting system of claim 11 wherein the sound generating device creates a sound until the long contact signal ceases.

13. The frequency controlled lighting system of claim 1 wherein the pattern generator interrupts any flashing pattern and illuminates a single lighting element in response to receiving the fast frequency signal from the fast frequency circuit.

14. The frequency controlled lighting system of claim 13 wherein the pattern generator illuminates the single lighting element until the fast frequency signal ceases.

15. The frequency controlled lighting system of claim 1 further comprising a sound generating device, activated by the pattern generator when the pattern generator interrupts any flashing pattern in response to receiving the fast frequency signal from the fast frequency circuit.

16. The frequency controlled lighting system of claim 15 wherein the sound generating device creates a sound until the long contact signal ceases.

17. The frequency controlled lighting system of claim 11 wherein the frequency controlled lighting system is located in a piece of footwear such that the controller and motion switch are located in a heel of the piece of footwear, at least one lighting element is located on the sole of the footwear or the outer surface of the footwear, and the sound generating device is located on the outer surface of the footwear.

18. The frequency controlled lighting system of claim 11 wherein the frequency controlled lighting system is located in a piece of footwear such that the controller and motion switch are located in a heel of the piece of footwear, at least one lighting element is located on the sole of the footwear or the outer surface of the footwear, and the sound generating device is located on the tongue of the footwear.

19. The frequency controlled lighting system of claim 1 wherein the frequency controlled lighting system is located in a piece of footwear such that the controller and motion switch are located in a heel of the piece of footwear and at least one of the lighting element is located on the sole of the footwear.

20. A frequency controlled lighting system comprising:

a motion switch to generate an activation signal in response to movement of the motion switch, the activation signal indicating at least one of duration and frequency of electrical engagement within the motion switch;

a signal analysis system electrically coupled to the motion switch to receive the activation signal and generate commands based on the activation signal;

a pattern generator electrically coupled to the signal analysis system to receive the commands from the signal analysis system and generate a dependant illumination pattern; and lighting elements electrically connected to the pattern generator, the lighting elements selectively actuated by the pattern generator to illuminate the lighting elements;

wherein the signal analysis system detects when the duration of electrical engagement within the motion switch is less than or equal to a predetermined duration level, when the duration of electrical engagement within the motion switch is greater than the predetermined duration level, and when the frequency of electrical engagement is greater than a predetermined frequency level, and generates commands based on the duration and frequency of electrical engagement.

21. A method for illuminating a series of lighting elements comprising:

creating an activation signal based on the movement of a motion switch;

based on the activation signal, determining a duration of electrical engagement and a frequency of electrical engagement within the motion switch for a period of time;

illuminating at least one of a series of lighting elements in response to activation of the motion switch;

comparing the duration of electrical engagement to a predetermined duration level to determine an illumination pattern for the series of lighting elements;

illuminating the series of lighting elements in one or more of a series of flashing patterns when the duration of electrical engagement is less than or equal to the predetermined duration level;

freezing any current flashing pattern and illuminating a single lighting element when the duration of electrical engagement is greater than the predetermined duration level; and comparing the frequency of electrical engagement within the motion switch to a predetermined frequency threshold to adjust the illumination pattern of the series of lighting elements.

22. The method of claim 21 wherein freezing any current flashing pattern and illuminating a single lighting element further comprises activating a sound generating device to produce a sound.

23. The method of claim 21 wherein freezing any current flashing pattern and illuminating a single lighting element continues until the electrical engagement which is greater than the predetermined duration level ceases.

24. The method of claim 22 wherein activating a sound generating device to produce a sound continues until the electrical engagement which is greater than the pre-determine duration level ceases.

25. The method of claim 21 wherein comparing the frequency of electrical engagement within the motion switch to a predetermined frequency threshold to adjust the illumination pattern of the series of light elements further comprises freezing any current flashing pattern of the lighting elements and illuminating a single lighting element when the frequency of electrical engagement is greater than the predetermined frequency threshold.

26. The method of claim 25 wherein freezing any current flashing pattern and illuminating a single lighting element further comprises activating a sound generating device to produce a sound.

27. The method of claim 25 wherein freezing any current flashing pattern and illuminating a single lighting element continues until the high frequency of electrical engagement within the motion switch ceases.

28. The method of claim 26 wherein activating a sound generating device to produce a sound continues until the rate of electrical engagement is less than the predetermined frequency threshold.

29. A frequency controlled lighting system comprising:

a motion switch to generate an activation signal in response to movement of the motion switch, the activation signal indicating at least one of duration and frequency of electrical engagement within the motion switch;

a controller electrically connected to the motion switch to receive the activation signal; and lighting elements, electrically connected to the controller, the lighting elements selectively actuated by the controller to illuminate the lighting elements in one or more predetermined illumination patterns dependant on the duration and frequency of electrical engagement indicated by the activation signal;

wherein the controller comprises:

a short contact circuit configured to generate a signal indicating the duration of an electrical engagement of the motion switch is less than or equal to a predetermined duration level;

a long contact circuit configured to generate a signal indicating the duration of the electrical engagement of the motion switch is greater than the predetermined duration level; and a fast frequency circuit configured to generate a signal indicating the frequency of electrical engagement of the motion switch is greater than a predetermined frequency threshold.

30. A frequency controlled lighting system comprising:

a motion switch comprising:

a spring having a fixed end and a free end, and a metal contact positioned proximate the free end of the spring for electrical engagement by the free end of the spring, wherein the motion switch generates an activation signal in response to motion of the motion switch, the activation signal indicating at least a duration of time that the spring electrically engages the metal contact;

a controller electrically connected to the motion switch to receive the activation signal, the controller comprising:

a signal analysis system to analyze the activation signal, and a pattern generator to receive commands from the signal analysis system and generate a dependant illumination pattern; and lighting elements electrically connected to said controller, the lighting elements selectively actuated by the pattern generator to illuminate the lighting elements in one or more of a series of predetermined illumination patterns dependant upon commands from the signal analysis system;

wherein the signal analysis system comprises:

a short contact circuit configured to signal the pattern generator when the duration of an electrical engagement between the spring and the metal contact is less than or equal to a predetermined duration level;

a long contact circuit configured to signal the pattern generator when the duration of the electrical engagement between the spring and the metal contact is greater than the predetermined duration level; and a fast frequency circuit configured to signal the pattern generator when the frequency of electrical engagement between the spring and the metal contact is greater than a predetermined frequency threshold.

31. The frequency controlled lighting system of claim 30 wherein the pattern generator illuminates a single lighting element upon activation of the motion switch.

32. The frequency controlled lighting system of claim 31 wherein the pattern generator illuminates only the single lighting element when the pattern generator receives a long contact signal from the long contact circuit.

33. The frequency controlled lighting system of claim 31 wherein the pattern generator illuminates the lighting elements in a flashing pattern when the pattern generator receives a short contact signal from the short contact circuit.

34. The frequency controlled lighting system of claim 33 wherein the pattern generator illuminates the lighting elements in a different pattern each time the pattern generator receives the short contact signal.

35. The frequency controlled lighting system of claim 33 wherein the pattern generator interrupts any flashing pattern of the lighting elements and activates a sound producing device when the pattern generator receives a fast frequency signal from the fast frequency circuit.

36. The frequency controlled lighting system of claim 32 wherein the pattern generator illumines only the single lighting element until the long contact signal ceases.

37. The frequency controlled lighting system of claim 32 wherein the pattern generator also activates a sound producing device when the pattern generator receives the long contact signal.

38. The frequency controlled lighting system of claim 37 wherein the pattern generator activates the sound producing device until the long contact signal ceases.

39. The frequency controlled lighting system of claim 33 wherein the pattern generator interrupts any flashing pattern of the lighting elements and illuminates a single lighting element when the pattern generator receives a fast frequency signal from the fast frequency circuit.

40. The frequency controlled lighting system of claim 39 wherein the pattern generator illuminates the single lighting element until the fast frequency signal ceases.

41. The frequency controlled lighting system of claim 35 wherein the pattern generator activates the sound producing device until the fast frequency signal ceases.

42. Footwear including a controlled lighting system comprising:

a motion switch to generate an activation signal in response to movement of the motion switch, the activation signal indicating at least one of duration and frequency of electrical engagement within the motion switch;

a controller electrically connected to the motion switch to receive the activation signal; and lighting elements, electrically connected to the controller, the lighting elements selectively actuated by the controller to illuminate the lighting elements in one or more predetermined illumination patterns dependant on the duration and frequency of electrical engagement indicated by the activation signal;

wherein the controller comprises:

a triggering circuit electrically connected to the motion switch to receive the activation signal, the triggering circuit creating a triggering signal upon reception of the activation signal;

an oscillator, electrically connected to the triggering means to receive the triggering signal, the oscillator creating a frequency signal upon reception of the triggering signal;

a time-base, electrically connected to the oscillator to receive the frequency signal, the time-base creating a timing signal upon reception of the frequency signal;

a short contact circuit, electrically connected to the time-base for receiving the timing signal and electrically connected to the triggering circuit to receive the activation signal, the short contact circuit generating a short contact signal when the duration of electrical engagement is less than or equal to the predetermined duration level;

a long contact circuit, electrically connected to the time-base to receive the timing signal and electrically connected to the triggering circuit to receive the activation signal, the long contact circuit generating a long contact signal when the duration of electrical engagement exceeds the predetermined duration level;

a fast frequency circuit, electrically connected to the time-base to receive the timing signal and electrically connected to the triggering circuit to receive the activation signal, the fast frequency circuit responsive to the activation signal and the timing signal to compare the frequency of electrical engagement to a predetermined frequency threshold and generating a fast frequency signal when the frequency of electrical engagement is greater than the predetermined frequency threshold; and a pattern generator, electrically connected to the time-base to receive the frequency signal, electrically connected to the short contact circuit to receive the short contact signal, electrically connected to the long contact circuit to receive the long contact signal, electrically connected to the fast frequency circuit to receive the fast frequency signal, and electrically connected to the lighting elements to selectively actuate the lighting elements in one or more of a series of predetermined patterns upon reception of the short contact signal, long contact signal, or fast frequency signal.

43. Footwear including the frequency controlled lighting system of claim 42 wherein the lighting elements are located in both the sole of the footwear and the outer surface of the footwear.

44. Footwear including the frequency controlled lighting system of claim 42 wherein the motion switch is a spring motion switch including a spring having a fixed end and a free end, and a metal contact positioned proximate the free end of the spring for electrical engagement by the free end of the spring.

45. Footwear including the frequency controlled lighting system of claim 44 wherein the duration of electrical engagement is the duration of time the free end of the spring electrically engages the metal contact.

46. Footwear including the frequency controlled lighting system of claim 42 wherein the motion switch is a magnetic reed motion switch including at least two contacts having a fixed end and a free end, wherein each contact is made of magnetic material, and an external magnet, positioned proximate the at least two contacts so that during movement of the switch a magnetic field from the external magnet forces the free end of each contact to electrically engage each other.

47. Footwear including the frequency controlled lighting system of claim 46 wherein the duration of electrical engagement is the duration of time the free end of each contact electrically engage each other.

48. Footwear including the frequency controlled lighting system of claim 42 wherein the lighting elements are located in the outer surface of the footwear.

49. Footwear including the frequency controlled lighting system of claim 42 wherein the pattern generator illuminates the lighting elements in one or more of the series of predetermined patterns each time the short contact circuit signals the pattern generator with the short contact signal.

50. Footwear including the frequency controlled lighting system of claim 49 wherein the pattern generator illuminates the lighting elements in a different pattern each time the short contact circuit signals the pattern generator.

51. Footwear including the frequency controlled lighting system of claim 42 wherein the pattern generator interrupts any flashing pattern and illuminates a single lighting element in response to receiving the long contact signal from the long contact circuit.

52. Footwear including the frequency controlled lighting system of claim 51 wherein the pattern generator illuminates the single lighting element until the long contact signal ceases.

53. Footwear including the frequency controlled lighting system of claim 42 further comprising a sound generating device, activated by the pattern generator when the pattern generator interrupts any flashing pattern in response to receiving the long contact signal from the long contact circuit.

54. Footwear including the frequency controlled lighting system of claim 53 wherein the sound generating device creates a sound until the long contact signal ceases.

55. Footwear including the frequency controlled lighting system of claim 42 wherein the pattern generator interrupts any flashing pattern and illuminates a single lighting element in response to receiving the fast frequency signal from the fast frequency circuit.

56. Footwear including the frequency controlled lighting system of claim 55 wherein the pattern generator illuminates the single lighting element until the fast frequency signal ceases.

57. Footwear including the frequency controlled lighting system of claim 42 further comprising a sound generating device, activated by the pattern generator when the pattern generator interrupts any flashing pattern in response to receiving the fast frequency signal from the fast frequency circuit.

58. Footwear including the frequency controlled lighting system of claim 57 wherein the sound generating device creates a sound until the long contact signal ceases.

59. Footwear including the frequency controlled lighting system of claim 42 wherein the motion switch is located in a heel of the footwear.

60. Footwear including the frequency controlled lighting system of claim 42 wherein the controller is located in a heel of the footwear.

61. Footwear including the frequency controlled lighting system of claim 42 wherein the lighting elements are located in the sole of the footwear.

62. Footwear including the frequency controlled lighting system of claim 57 wherein the sound generating device is located on the outer surface of the footwear.

63. Footwear including the frequency controlled lighting system of claim 57 wherein the sound generating device is located on the tongue of the footwear.

* * * * *